US008276653B2

(12) United States Patent
Al-Anizi et al.

(10) Patent No.: US 8,276,653 B2
(45) Date of Patent: Oct. 2, 2012

(54) RAISED OVERLAPPED IMPINGEMENT PLATE

(75) Inventors: Salamah S. Al-Anizi, Dhahran (SA); Abdullah M. Al-Otaibi, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 997 days.

(21) Appl. No.: 12/079,679

(22) Filed: Mar. 28, 2008

(65) Prior Publication Data

US 2009/0242178 A1 Oct. 1, 2009

(51) Int. Cl.
*F28D 7/00* (2006.01)

(52) U.S. Cl. ..... 165/159; 165/134.1; 165/160; 165/161; 165/162

(58) Field of Classification Search ..... 165/159, 165/160, 161, 162, 134.1
See application file for complete search history.

(56) References Cited

U.S. PATENT DOCUMENTS

| | | | | | |
|---|---|---|---|---|---|
| 1,226,299 | A | * | 5/1917 | Boltz | 165/159 |
| 1,673,409 | A | * | 6/1928 | Kelley | 165/148 |
| 3,042,379 | A | * | 7/1962 | Hinde | 165/162 |
| 3,351,131 | A | * | 11/1967 | Berthold | 165/159 |
| 4,140,178 | A | * | 2/1979 | Ohlswager et al. | 165/161 |
| 4,254,825 | A | * | 3/1981 | Imazu | 165/160 |
| 4,415,024 | A | * | 11/1983 | Baker | 165/160 |
| 4,520,868 | A | * | 6/1985 | Grawey | 165/159 |
| 4,576,222 | A | | 3/1986 | Granata | |
| 5,058,664 | A | * | 10/1991 | Gentry | 165/162 |
| 5,465,783 | A | * | 11/1995 | O'Connor | 165/134.1 |
| 5,653,282 | A | | 8/1997 | Hackemesser | |
| 6,167,713 | B1 | * | 1/2001 | Hartfield et al. | 165/160 |
| 6,868,695 | B1 | | 3/2005 | Dingel | |

FOREIGN PATENT DOCUMENTS

JP 05187792 A 7/1993

OTHER PUBLICATIONS

ISR & Written Opinion, PCT/US 2009/001953, mailed Aug. 27, 2009.

* cited by examiner

*Primary Examiner* — Cheryl J Tyler
*Assistant Examiner* — Orlando E Aviles Bosques
(74) *Attorney, Agent, or Firm* — Abelman, Frayne & Schwab

(57) ABSTRACT

A heat exchanger for transfer of heat from a first fluid to a second fluid, including: a housing defining an interior space, a plurality of tubes spaced apart from each other and extending in a first direction in the interior space in the housing, a first inlet for flow of the first fluid into the tubes, a second inlet for flow of the second fluid into the interior space about the external surfaces of the tubes, the second fluid flowing in a direction generally transverse of the first direction, and an impingement plate assembly situated in the interior space between the second inlet and the plurality of tubes, the impingement plate assembly including: (a) a top plate facing the second inlet, and (b) a bottom plate spaced from and generally parallel to and underlying the top plate with an aperture extending through said bottom plate from top to bottom thereof.

18 Claims, 6 Drawing Sheets

Figure 1:
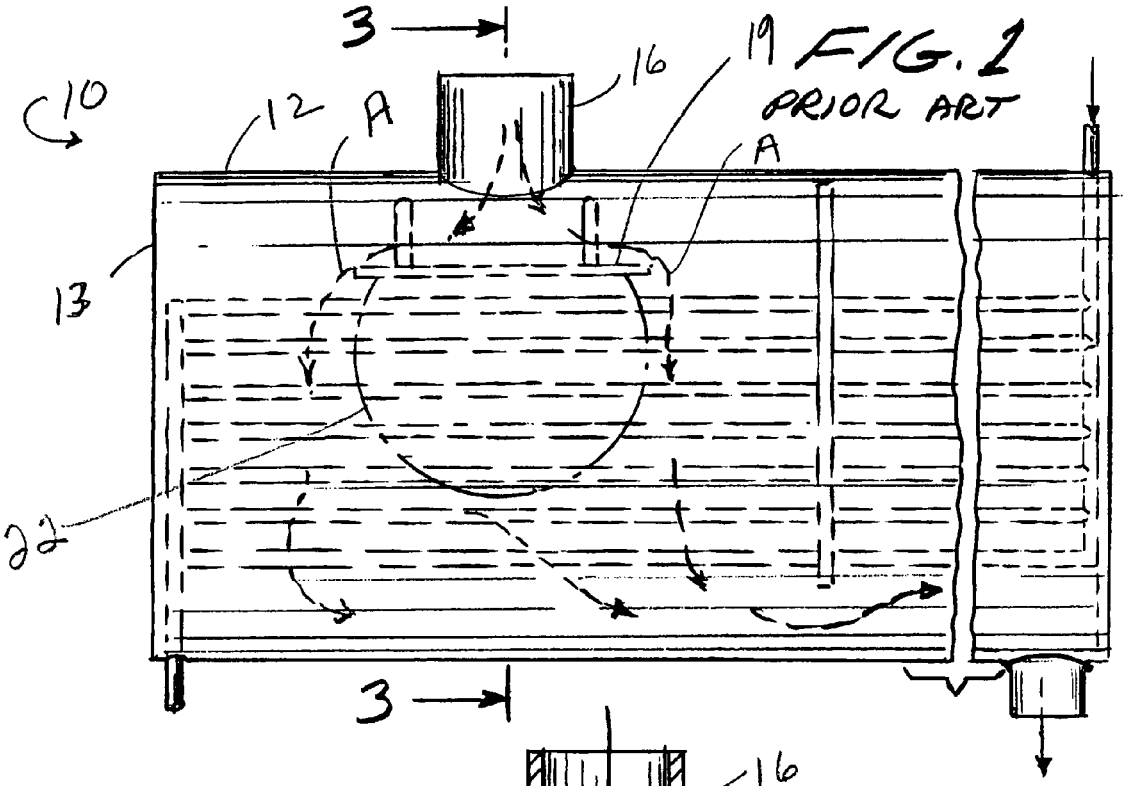
FIG. 1 PRIOR ART

6A
28
16
30

A
31
40
23
7
7
20A
20B
20C
20D
20E
20F
20G
B
35
B
35
24
6A
C
18

31
9
30
32

9
33
34

31
A
A
32
B
B
33

6A
16
30

A
31
40
23
7
7
20A
20B
20C
20D
20E
20F
20G
B
35
B
35
24
6A
18

RAISED OVERLAPPED IMPINGEMENT PLATE

I. BACKGROUND

A. Field of the Invention

This invention is in the field of heat exchangers used to transfer heat from one fluid to another, and particularly heat exchangers to transfer heat to one fluid flowing through a shell from a second fluid flowing through tubes extending through such a shell.

B. Background of the Invention

Fluid heat exchangers are widely used in the industry, one common heat exchanger comprising a cylindrical housing or shell encompassing a bundle of tubes, wherein heat from a first fluid flowing through the tubes is transferred to a second fluid flowing through the housing, as a result of the second fluid flowing in contact with the outer surfaces of said tubes. The second fluid enters the shell through a nozzle and is directed initially to an impingement plate which deflects and redirects the second fluid to flow toward and about the outer surfaces of said tubes, as generally disclosed in U.S. Pat. No. 3,938,588

The inlet fluid initially has a high velocity and dynamic force when it impacts on the impingement plate. In many conventional shell and tube type heat exchangers the impingement plate adjacent the inlet nozzle protects the tubes from direct impact of the high velocity inlet fluid, but often creates operational problems when fluid flowing downstream of the impingement plate has reduced velocity due to the vortex effect of fluid motion at the sides of the impingement plate. This results in fouling accumulation on surfaces of the tubes, particularly in the region designated herein as "fouling area" immediately below the conventional impingement plate. Such fouling retards heat transfer to tubes in that area and furthermore may create a corrosive environment on the outer surfaces of said tubes. The present invention provides a new and very different impingement plate device to reduce fouling accumulation, to enhance heat transfer and to reduce corrosion.

II. OBJECTS AND SUMMARY OF THE NEW INVENTION

The new impingement plate assembly which may be used within a conventional shell and tube type heat exchanger housing, comprises a set of upper and lower plates arranged in a fixed relationship where they are generally parallel, spaced apart and overlying, and where the top plate has a contiguous surface facing and adjacent an inlet fluid flow nozzle for fluid entering the shell, and the bottom plate has a central or other flow aperture. With this new impingement plate assembly, inlet fluid impinges on the top plate, then flows radially outward along the top of the top plate, and then flows into a number of flow paths, namely:

(a) a flow radially inward between said top and bottom plates, thence downward through the aperture in the bottom plate, and thence about the outer surfaces of various tubes in the fouling area immediately and/or directly below said bottom plate, and (b) a flow downward and outward of said bottom plate, and thence about the outer surfaces of various of the tubes of the tube bundle which are generally remote from said fouling area. In such fluid flow environment it is expected that some of the fluid from paths (a) and (b) will become intermixed.

In this first embodiment of the new impingement plate assembly the top and bottom plates are maintained one above and spaced from the other by a plurality of spacer elements, so that the fluid can readily flow transversely between said plates until it flows downward through said aperture in the bottom plate. Preferably, the top and bottom plates are circular and concentric about a central axis extending downwardly from said inlet nozzle above, through said top and bottom plates and through the central aperture in said bottom plate.

With the new impingement plate assembly there is protection for the tubes from direct high velocity impact of the inlet fluid, change of the fluid's velocity profile downstream of the impingement plate assembly, and enhanced flow of the fluid to the fouling area which prevents or removes fouling accumulation.

In the preferred embodiment of the new impingement plate assembly, the lower plate has outer diameter greater than that of the top plate and has a central opening of diameter corresponding generally to the inside diameter of the nozzle. The side opening or vertical spacing between the top and bottom plates allows for generally radially inward side flow to the central opening in the lower plate. Advantages of the new impingement plate assembly include reducing initial flow impact upon the tubes by maintaining the main function of the solid impingement plate and allowing suitable flow which will scrub the outer surfaces of tubes downstream in the fouling area.

In summary, with the new impingement plate assembly, the inner flow passing through the aperture in the bottom plate to the fouling area:

(a) prevents and/or cleans the deposit accumulation downstream of the impingement plate, (b) enhances heat transfer between the fluid in the tubes and the fluid flow in the shell, (c) prevents or greatly reduces corrosion, and (d) protects tubes from the possibility of overheating due to lack of cooling in the fouling area.

Thus, a first object of the present invention is to provide an improved impingement plate assembly for a shell and tube type heat exchanger which produces an improved fluid flow about tubes in the traditional fouling area and results in a reduction in deposits on the outer surfaces of the tubes, better heat transfer between shell-side fluid and tube-side fluid, and/or reduced corrosion on the outer surfaces of the tubes.

It is a further object to achieve the improved fluid flow pattern with a impingement plate assembly that receives the direct inlet fluid flow and then deflects and redirects part of this flow through said impingement plate assembly onto said tubes in said fouling area.

An additional object is to form said new impingement plate assembly with a continuous surface top plate that receives the direct inlet flow from an inlet nozzle in said shell or housing, and a bottom plate adjacent, spaced below and overlying said top plate and having at least one aperture extending through it from top to bottom. With this new impingement plate assembly some of the fluid that strikes the top surface of the top plate will flow down and around the outside edge of said top plate, and then generally radially inwardly in the space between said plates, and then downward through said aperture in said bottom plate into said fouling area where it flows onto and about the outer surfaces of said tubes in said fouling area.

An additional object is to recover more heat from tube-side fluid by reducing fouling on the outer surface of said tubes, and thus improving shell-side fluid flow onto said outer surfaces of said tubes.

A still further object is to increase overall heat transfer efficiency with the new improved impingement plate assembly.

Other objects and advantages of the present invention will become apparent from the detailed description given hereinafter. Thus, it should be understood that the detailed description and specific embodiments are given by way of illustration only, since various changes and modifications within the spirit and scope of the invention will become apparent to those skilled in the art from this detailed description.

III. BRIEF DESCRIPTION OF THE DRAWINGS

Figure 3:
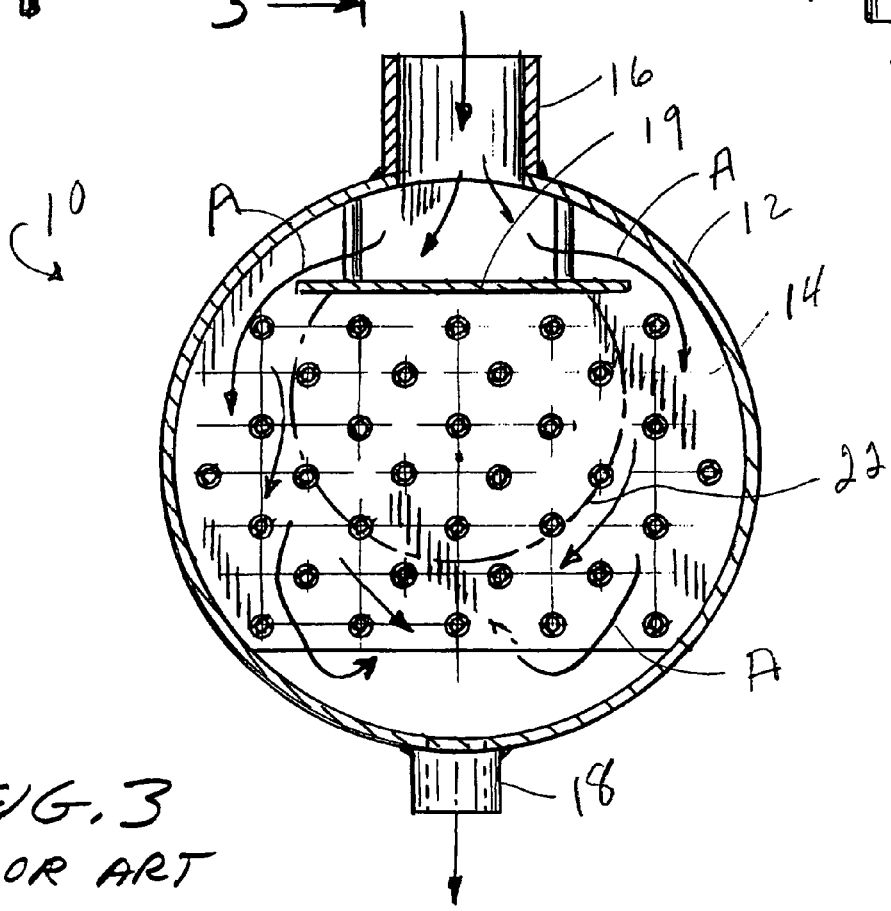
FIG. 3 PRIOR ART
Figure 2:
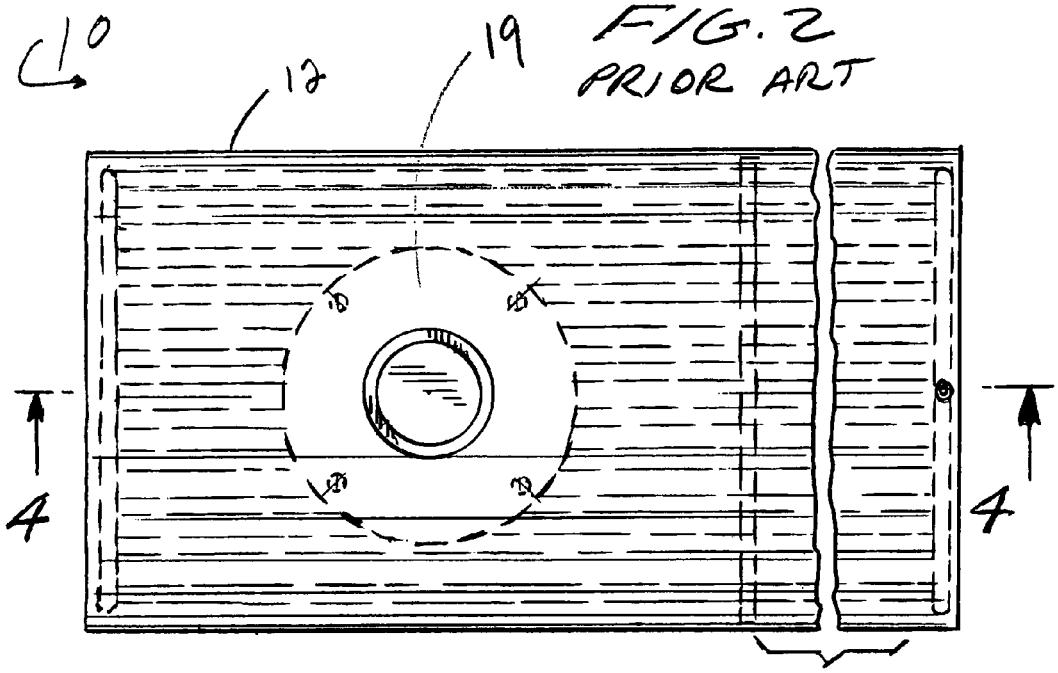
FIG. 2 PRIOR ART
Figure 4:
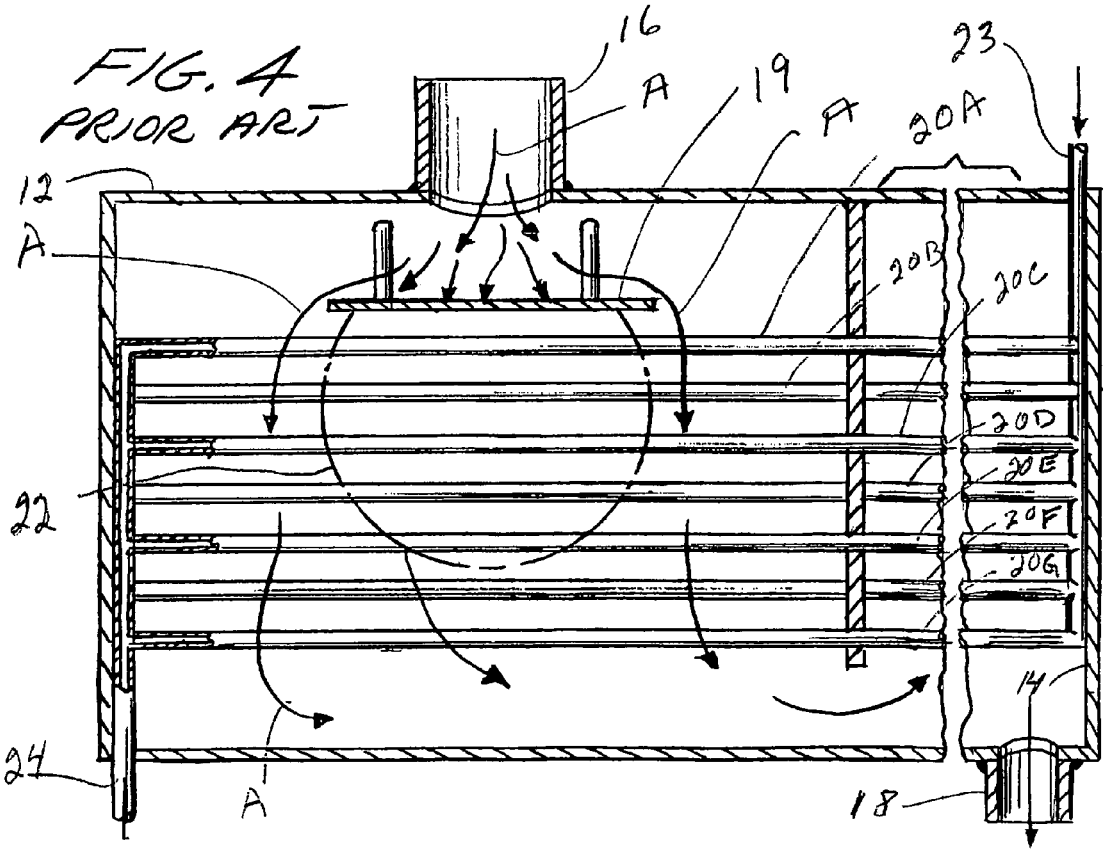
FIG. 4 PRIOR ART
Figure 5:
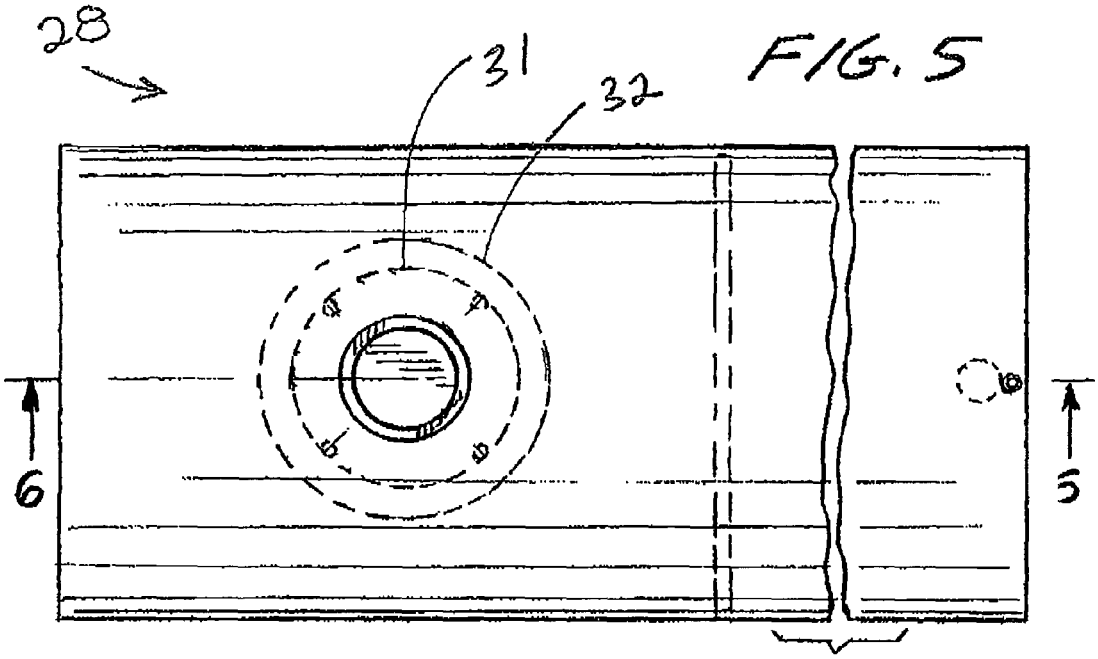
Figure 7:
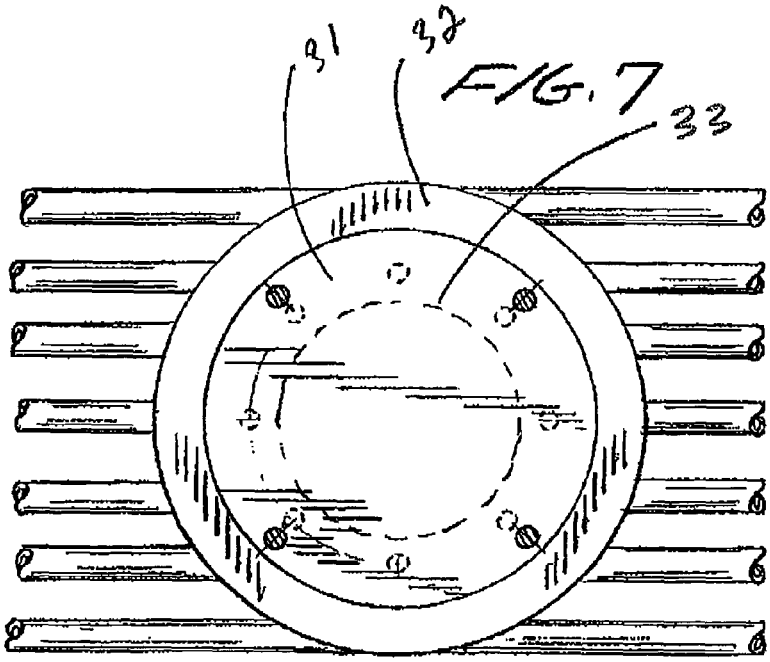
Figure 6:
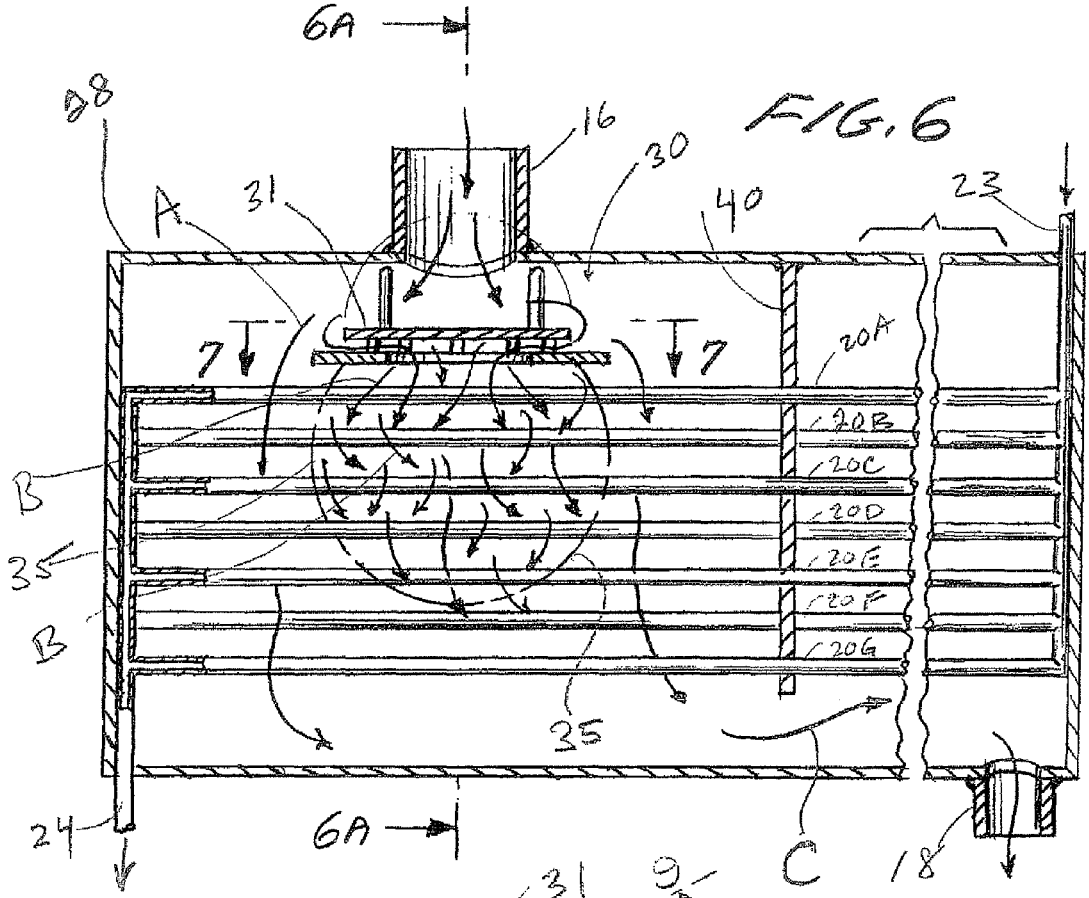
Figure 8:
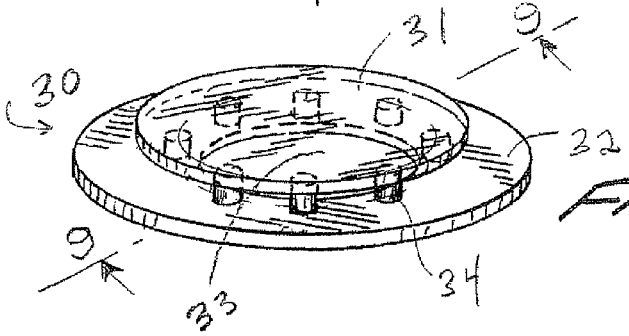
Figure 9:
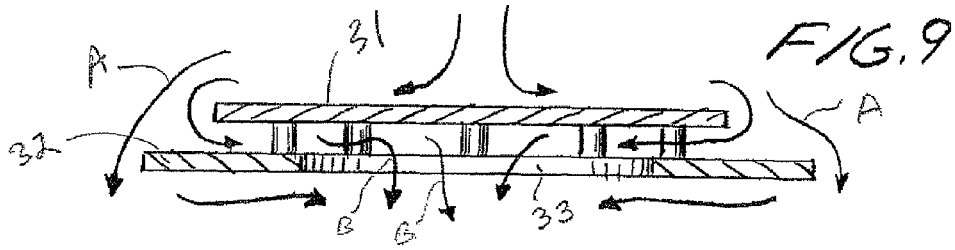
Figure 6A:
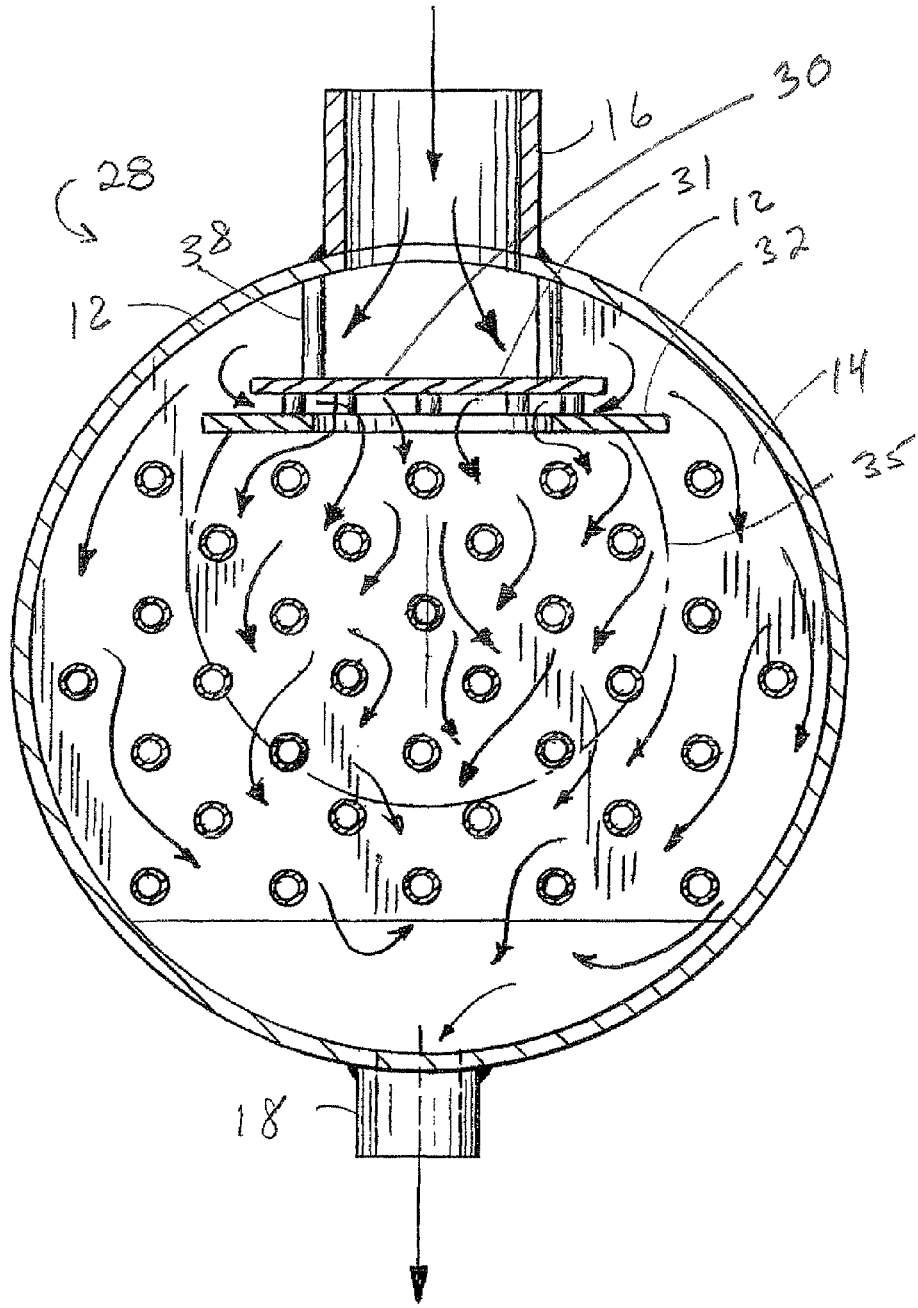

FIG. 1 is a fragmentary elevation view of a prior art heat exchanger including a prior art impingement plate, FIG. 2 is a fragmentary top plan view of the prior art heat exchanger of FIG. 1, FIG. 3 is an elevation view in section taken along long 3-3 in FIG. 1 of said prior art heat exchanger and prior art impingement plate, FIG. 4 is a fragmentary elevation view and section taken along line 4-4 in FIG. 2 of said prior art heat exchanger and prior art impingement plate, FIG. 5 is a top plan view of a heat exchanger of the present invention, FIG. 6 is a fragmentary elevation view in section taken along line 6-6 in FIG. 5, showing the new impingement plate assembly, FIG. 6A is a fragmentary elevation view in section taken along lines 6A-6A in FIG. 6, showing the fluid flow pattern in a heat exchanger with the new impingement plate assembly, FIG. 7 is a fragmentary plan view taken along line 7-7 of FIG. 6, showing the new impingement plate assembly, FIG. 8 is a top perspective view of the new impingement plate assembly, and FIG. 9 is an enlarged side elevation view in section taken along line 9-9 in FIG. 8, showing said new impingement plate assembly.

Figure 10:
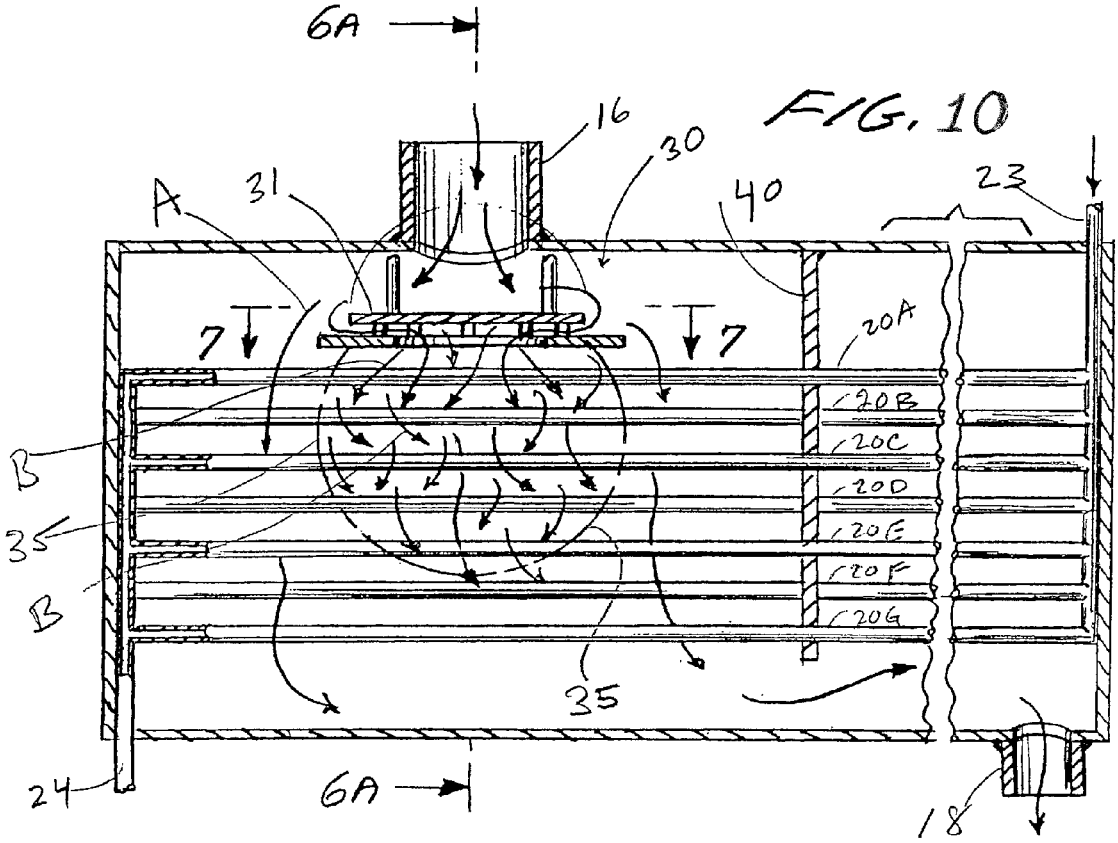

FIG. 10 is a fragmentary elevation view in section similar to FIG. 6, but showing the second fluid flow in a direction opposite the second fluid flow in FIG. 6.

IV. DETAILED DESCRIPTION OF THE PREFERRED EMBODIMENT

For convenience and clarity in describing these embodiments, similar elements or components appearing in different figures will have the same reference numbers.

FIGS. 1-4 illustrate a conventional prior art heat exchanger with a conventional impingement plate situated inward and adjacent of the inlet nozzle and between said inlet nozzle and a bundle of tubes.

More particularly these figures show a cylindrical heat exchanger 10 formed of a cylindrical shell housing or shell 12 with first end 13 appearing on the left side of FIG. 1 and opposite end 14.

As shown in these figures, housing 12 has a principal or typical fluid inlet 16 and an outlet 18. Fluid flowing from inlet 16 to outlet 18 initially strikes impingement plate 19, and then follows primarily the path indicated by long arrows A, flowing between, around and engaging the outer surfaces of tubes 20A-20G.

Arrows A indicate how the fluid from inlet 16 tends to not flow in the fouling area 22 shown in the dashed line generally circular area in the upper region of the housing and directly below impingement plate 19. As discussed above, it is in this region where deposits and fouling accumulate on the surfaces of tubes 20A-20C. This accumulation inhibits heat exchange with the fluid flowing within tubes 20A-20D by reducing the ability of the in-flowing fluid to freely circulate around these tubes and thus reduces the efficiency of the heat transfer. Also, this fouling may cause corrosion on the surfaces of these tubes.

In the prior art impingement plate shown in FIGS. 1-4 it is typical for tubes 20A-20G to transport a first fluid of relatively elevated temperature, the heat from this fluid in tubes 20A-20G being transferred to a second fluid flowing from inlet 16 to outlet 18. For convenience herein, the fluid within tubes 20A-20G will be designated at "tube-side fluid" and the fluid flowing from inlet 16 to outlet 18 and flowing across and in contact with the outer surfaces of said tubes will be designated "shell-side fluid".

The above-mentioned area of fouling and accumulation designated with reference number 22 and shown in FIGS. 1, 3 and 4, is not a precise area, but is the region where the above-mentioned fouling occurs.

The preferred embodiment of the new impingement plate assembly is illustrated in FIGS. 5, 6, 6A, 7, 8 and 9. For simplicity and clarity, the heat exchanger 28 in FIGS. 5-9 will be shown as having the same housing or shell 12 as in FIGS. 1-4 and also having the same inlet 16 outlet 18 and bundle of tubes 20A-20G. Also, as seen in FIG. 4 and now seen in FIG. 6, the inner tubes 20A-20G have a representative inlet manifold 23 and a representative outlet manifold 24. Obviously, tubes 20A-20G could have a variety of other inlet and outlet arrangements. As mentioned above, in the present embodiments it is understood that flowing in these tubes is a relatively hot fluid, with heat transfer from the outer surfaces of these tubes to the relatively cooler second fluid flowing from inlet 16 through the shell housing to outlet 18.

The FIGS. 5-9 illustrate in the heat exchanger housing 12, the new impingement plate assembly 30 which comprises top or raised plate 31 in the form of a flat solid disk which is shown as un-perforated by apertures therethrough, and bottom or back plate 32 in the form of a larger flat disk having an aperture 33 therein. These disks are arranged concentrically and attached together by a plurality of spacer elements 34, which themselves are spaced apart circumferentially and establish a fixed predetermined vertical distance between the top and bottom plates 31 and 32 so that as seen in FIGS. 6A and 9 they are parallel. Also, the circumferential spacing of spacers 34 provides clearance for said second liquid to flow generally radially inward between said top and bottom plates, and thence downwardly via said aperture 33 in bottom plate 32 to the fouling area. As stated above one object of the new invention is for the upper and lower plates to be generally parallel and in this preferred embodiment said plates are a fixed distance apart and illustrated as parallel.

FIGS. 6 and 9 illustrate the general flow path of said second liquid entering inlet 16, thence striking top plate 31 of impingement plate assembly 30, and thence flowing in two basic paths:

(a) as indicated by short arrows B indicating flow radially inward between top and bottom plates 31 and 32, respectively and thence downward through aperture 33, and thence swirling around and among the outer surface areas of tubes 20A-20D immediately below the impingement plate assembly in the fouling area or region indicated by the circle 35 of dashed lines, and (b) as indicated with long arrows marked A, generally outwardly from the area directly beneath the impingement plate assembly.

As best seen in FIG. 6 the area 35 is now well-washed with the second heat transfer fluid which flow in area 35 greatly reduces or even prevents accumulation of deposits on the tubular surfaces in this area, and thus allows these tubular surfaces to maintain their most efficient heat transfer capability. Also, the elimination of these deposits reduces or prevents corrosion on these surfaces. Furthermore, the more efficient heat transfer from these surfaces increases protection of these tubes from overheating due to lack of heat transfer from them. And finally, as a consequence, of this new structure and fluid-flow arrangement there is an overall improved and more efficient heat transfer of the entire heat exchanger system.

The preferred embodiment as seen in FIGS. 5-9, comprises concentric top and bottom disks 31 and 32; however, this invention is not limited to top and bottom plates which are circular or coaxial and concentric or totally flat as shown. The exact dimensions of the plates (or exact diameters if they are disks) and the spacing between the plates can be varied, depending on the nature of the fluid, the velocity of the fluid, the intended heat transfer, etc.; however, in one set of preferred embodiments the relative dimensions of the top and bottom plate components 31,32 compared to the inlet nozzle 16 are defined as follows, where:

$D_z$ is the inlet nozzle 16 inner diameter, $D_2$ (the outside diameter of top plate 31)= $D_z/2+2''$ $D_4$ (the outside diameter of bottom plate 32)= $D_z+2$.

$D_3$ (the inside diameter of aperture in bottom plate 32)= $D_z/2$.

Also, in this set of preferred embodiments, the distance h from the discharge outlet of the inlet nozzle 16 to the top plate 31, $$\text{for } D_z \geq 8'',\ h \geq \frac{D_z^2 - D_z - 4}{4D_z}, \text{ and} \quad \text{(a)}$$

$$\text{for } D_z < 8'',\ h > 3/16\,D_z \quad \text{(b)}$$

Finally, in this set of preferred embodiments the height distance between the top and bottom plates 31,32 is about 0.5" (1.25 cm), and the thickness of these plates is about 0.236" (6 mm).

FIG. 6A further illustrates the flow of liquid through inlet 16, onto top plate 31, and thence through aperture 33 in lower plate 32, and thereafter the flow in the now non-fouling area 35 about and around tubes 20A-20D.

The improvement by the new impingement plate assembly overcomes or greatly reduces fouling accumulation on the tubes downstream of the impingement plates caused by very low velocity or absence of flow of the fluid in this area below the impingement plate assembly. With the new device, not only is there established an adequate fluid flow onto and around the surface areas of the tubes directly below the impingement plate assembly but a flow of adequate velocity to achieve cleaning and scrubbing and also to achieve recovery of heat from those surfaces.

FIG. 6 also includes baffle plate 40 which tends to direct and maintain principal inlet flow in the area below the impingement plate assembly before the flow continues downstream toward remaining portions of the tubes and the shell.

The new impingement plate assembly comprises plates which are made of material similar or the same as that in prior art impingement plates such as stainless steel or other material resistant to corrosion and damage from the environment within the heat exchanger. As seen in FIG. 6A the new impingement plate assembly 30 is attached as in prior art heat exchangers or by any other suitable means.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the appended claims.

The invention claimed is:

1. A heat exchanger for transfer of heat between a second fluid flowing at a high velocity and a first fluid, comprising:

a. a housing defining an interior space, b. a plurality of heat exchange tubes spaced apart from each other, fixed in said housing, and extending in a first direction within said interior space, c. first inlet for receiving said first fluid into and through said tubes, and first outlet for discharging said first fluid out of said tubes, d. second inlet for receiving said second fluid into said interior space in an inlet flow direction transverse of said first direction, whereby outer surfaces of said heat exchange tubes in said interior space are contacted by said second fluid flow, and second outlet for discharging said second fluid out of said interior space, and e. an impingement plate assembly situated in said interior space of said housing between said second inlet and said plurality of tubes and comprising:

(i) a top plate facing said second inlet and mounted in said housing, said top plate having an unperforated top surface that lies in a plane transverse to said inlet flow direction and onto which said second fluid flow impinges, said top plate thus positioned to block said second fluid flow from direct high velocity impingement on said heat exchange tubes, and (ii) a bottom plate fixed to, spaced apart from and generally parallel to said top plate, wherein said top plate is overlying said bottom plate, said bottom plate defining therethrough an aperture extending from top to bottom thereof, whereby said fluid flow exiting said aperture in said bottom plate moves in a flow path about said heat exchange tubes that reduces stagnation of said fluid about said tubes and reduces corrosion of said tubes' outer surfaces, (iii) said impingement plate assembly further comprising spacer elements maintaining said bottom plate said spaced apart from said top plate, with a central axis extending in the top to bottom direction through said top and bottom plates, said spacer elements being spaced apart about said central axis and fixed to said top and bottom plates, whereby said plates define between them a flow path for part of said second fluid after it impinges on said top plate to flow between said top and bottom plates and thence downward through said aperture in said bottom plate.

2. The heat exchanger according to claim 1, where said top and bottom plates are spaced apart a distance of about 0.5 inch.

3. The heat exchanger according to claim 1, where said second inlet comprises an inlet nozzle having inner diameter D, and where said top plate has outer diameter of about two inches greater than half of said inlet nozzle diameter, and said bottom plate has outer diameter of about two inches greater than said inlet nozzle diameter, and an inner diameter about half of the inlet nozzle diameter.

4. The heat exchanger according to claim 1, wherein said second fluid after exiting said fouling area, flows along said tubes in a direction generally opposite the flow direction of said first fluid flowing in said tubes.

5. The heat exchanger according to claim 1, wherein said second fluid after exiting said fouling area, flows along said tubes in a direction generally the same as the flow direction of said first fluid flowing in tubes.

6. The heat exchanger according to claim 1, wherein said housing has a generally elongated cylindrical shape with a central longitudinal axis, and said plurality of tubes extend generally parallel to said central longitudinal axis.

7. The heat exchanger according to claim 1, wherein said top and bottom plates are of metal and have thickness of about 6 mm.

8. The heat exchanger according to claim 1, wherein said top and bottom plates are generally round disks and have a common central axis.

9. An impingement plate assembly for use in a heat exchanger for transfer of heat between a second fluid flowing at a high velocity and a first fluid, where said heat exchanger includes:

a. a housing defining an interior space, b. a plurality of heat exchange tubes spaced apart from each other, fixed in said housing, and extending in a first direction within said interior space, c. first inlet for receiving said first fluid into and through said tubes, and first outlet for discharging said first fluid out of said tubes, and d. second inlet for receiving said second fluid into said interior space in an inlet flow direction transverse of said first direction, whereby outer surfaces of said heat exchange tubes in said interior space are contacted by said second fluid flow, and second outlet for discharging said second fluid out of said interior space, said impingement plate assembly situated in said interior space of said housing between said second inlet means and said plurality of tubes and comprising:

(i) a top plate facing said second inlet and mounted in said housing, said top plate having an unperforated top surface that lies in a plane transverse to said inlet flow direction and onto which said second fluid flow impinges, said top plate thus positioned to block said second fluid flow from direct high velocity impingement on said heat exchange tubes, and (ii) a bottom plate fixed to, spaced apart from and generally parallel to said top plate wherein said top plate is overlying said bottom plate, said bottom plate defining therethrough an aperture extending from top to bottom thereof, whereby said fluid flow exiting said aperture in said bottom plate moves in a flow path about said heat exchange tubes that reduces stagnation of said fluid about said tubes and reduces corrosion of said tubes' outer surfaces, (iii) said impingement plate assembly further comprising spacer elements maintaining said bottom plate said spaced apart from said top plate, with a central axis extending in the top to bottom direction through said top and bottom plates, said spacer elements being spaced apart about said central axis and fixed to said top and bottom plates, whereby said plates define between them a flow path for part of said second fluid after it impinges on said top plate to flow between said top and bottom plates and thence downward through said aperture in said bottom plate.

10. The impingement plate assembly according to claim 9 where said heat exchanger includes an inlet nozzle having inner diameter Dz for directing fluid directly onto said top plate of said impingement plate assembly, and where said top plate has outer diameter of about two inches greater than Dz/2, and said bottom plate has outer diameter of about two inches greater than Dz, and said bottom plate inner diameter is about Dz/2.

11. The impingement plate assembly according to claim 9 wherein said top and bottom plates are generally parallel.

12. The impingement plate assembly according to claim 9 wherein said bottom plate has greater length and width dimensions than said top plate, and said top and bottom plates have a common generally central axis extending between them in the top to bottom direction.

13. The Impingement plate assembly according to claim 11 wherein said top and bottom plates are generally round, said bottom plate has an outer diameter greater than that of said top plate.

14. The impingement plate assembly according to claim 13 wherein said bottom plate aperture is generally round.

15. The impingement plate assembly according to claim 12 further comprising a plurality of spacer elements spaced apart circumferentially about said central axis and fixed to said top and bottom plates.

16. A method of improving heat exchange between a first fluid flowing in tubes and a second fluid flowing in a housing and about and contacting said tubes in said housing and of reducing fouling of the surfaces of tubes in a heat exchanger which includes a first fluid flowing in said tubes and a second fluid flowing from a second inlet in a housing and about and contacting said tubes in said housing, comprising the steps:

a. providing in said housing an impingement plate assembly having a solid un-perforated top plate and a perforated bottom plate, said top plate attached to, spaced from and overlying said bottom plate, b. directing a flow of said second fluid via said second inlet onto said top plate of said impingement plate assembly, c. directing part of said flow of said second fluid after it strikes said top plate to flow between said top and bottom plates and thence through said aperture in said bottom plate to a fouling area immediately below said impingement plate assembly and onto the surfaces of said tubes in said fouling area, d. directing another portion of said second fluid outward and downward from said impingement plate assembly to areas outward of said fouling area, and thence to said second outlet, and e. directing said first fluid through said plurality of tubes from first inlet to said first outlet for said first fluid; and said impingement plate assembly further comprising spacer elements maintaining said bottom plate said spaced apart from said top plate, with a central axis extending in the top to bottom direction through said top and bottom plates, said spacer elements being spaced apart about said central axis and fixed to said top and bottom plates, whereby said plates define between them a flow path for part of said second fluid after it impinges on said top plate to flow between said top and bottom plates and thence downward through said aperture in said bottom plate.

17. The method according to claim 16 comprising the further step of forming said impingement plate assembly device of a solid top plate and a larger diameter bottom plate in which said top plate is above and overlying said bottom plate, providing an aperture in said bottom plate, and positioning said top plate to be transverse of the inlet fluid flow of said second fluid which impinges on said top plate and flows between said plates and downward through the aperture in said bottom plate.

18. A heat exchanger for transfer of heat between a second fluid flowing at a high velocity and a first fluid, comprising:

a. a housing defining an interior space, b. a plurality of heat exchange tubes spaced apart from each other, fixed in said housing, and extending in a first direction within said interior space, c. first inlet for receiving said first fluid into and through said tubes, and first outlet for discharging said first fluid out of said tubes, d. second inlet for receiving said second fluid into said interior space in an inlet flow direction transverse of said first direction, whereby outer surfaces of said heat exchange tubes in said interior space are contacted by said second fluid flow, and second outlet for discharging said second fluid out of said interior space, and e. an impingement plate assembly situated in said interior space of said housing between said second inlet and said plurality of tubes and comprising:

(i) a top plate facing said second inlet and mounted in said housing, said top plate having an unperforated top surface that lies in a plane transverse to said inlet flow direction and onto which said second fluid flow impinges, said top plate thus positioned to block said second fluid flow from direct high velocity impingement on said heat exchange tubes, and (ii) a bottom plate fixed to, spaced apart from and generally parallel to said top plate wherein said top plate is overlying said bottom plate, said bottom plate defining therethrough only one aperture extending from top to bottom and generally centrally thereof, whereby said fluid flow exiting said aperture in said bottom plate moves in a flow path about said heat exchange tubes that reduces stagnation of said fluid about said tubes and reduces corrosion of said tubes' outer surfaces.

* * * * *